United States Patent [19]

Rembold

[11] Patent Number: 4,718,391

[45] Date of Patent: Jan. 12, 1988

[54] FUEL INJECTION PUMP FOR INTERNAL COMBUSTION ENGINES

[75] Inventor: Helmut Rembold, Stuttgart, Fed. Rep. of Germany

[73] Assignee: Robert Bosch GmbH, Stuttgart, Fed. Rep. of Germany

[21] Appl. No.: 947,251

[22] Filed: Dec. 29, 1986

[30] Foreign Application Priority Data

Jan. 30, 1986 [DE] Fed. Rep. of Germany ..... 3602713

[51] Int. Cl.[4] ..... F02D 41/40; F02M 59/20

[52] U.S. Cl. ..... 123/506; 123/357; 123/381; 123/494

[58] Field of Search ..... 123/357, 381, 446, 449, 123/467, 494, 506

[56] References Cited

U.S. PATENT DOCUMENTS

| | | | |
|---|---|---|---|
| 4,505,240 | 3/1985 | Shinoda et al. | 123/506 X |
| 4,546,749 | 10/1985 | Igashira et al. | 123/494 X |
| 4,572,132 | 2/1986 | Piwonka | 123/357 |
| 4,603,669 | 8/1986 | Takemoto et al. | 123/506 X |

FOREIGN PATENT DOCUMENTS

| | | | |
|---|---|---|---|
| 3504083 | 8/1986 | Fed. Rep. of Germany | 123/506 |
| 0133440 | 8/1983 | Japan | 123/381 |
| 2061403 | 5/1981 | United Kingdom | 123/357 |

*Primary Examiner*—Willis R. Wolfe, Jr.
*Attorney, Agent, or Firm*—Edwin E. Greigg

[57] ABSTRACT

A fuel injection pump for internal combustion engines has a pump piston, defining a pump work chamber for generating an injection pressure; an electromagnetic control device for fixing the duration of supply during the supply stroke of the pump piston and a measuring device, which measures the return flow fuel quantity that did not attain injection during the supply stroke of the pump piston and emits an electronic return flow quantity signal ($Q_R$). An electronic control unit imposes control signals ($\phi_{\mu V}$) upon the control device as a function of the return flow quantity signal ($Q_R$) and operating characteristics of the engine. To attain highly accurate closed-loop control of the fuel injection quantity, a fluctuation detector is provided, which detects fluctuations in the return flow quantity signal and emits the appearance of fluctuations over time in the form of detection signals ($\phi_A$, $\phi_E$, $\phi_1$–$\phi_4$). The control unit corrects the imposition of the control signals ($\phi_{\mu V}$) as a based on these detection signals.

15 Claims, 6 Drawing Figures

*
**

FUEL INJECTION PUMP FOR INTERNAL COMBUSTION ENGINES

BACKGROUND OF THE INVENTION

The invention is based on a fuel injection pump for internal combustion engines of the generic type defined hereinafter.

A fuel injection of this type described in the main patent (German patent application No. P 35 04 083.1) has the substantial advantage that the quantity of fuel to be injected is determined in a closed control loop, in that by detecting the return flow quantity of fuel not attaining injection during a supply stroke of the pump piston, the injected fuel quantity is ascertained and is corrected by varying the control signal supplied to the electromagnetic control device.

OBJECT AND SUMMARY OF THE INVENTION

The fuel injection pump according to the invention has the advantage that the determination of the injection quantity is made more precise with additional data from the measured return flow fuel quantity. The fluctuations therein, which are detectable by differentiation of the return flow quantity signal, enable a conclusion to be drawn as to the cam supply onset, the onset of closure of the electromagnetic control device, its closing time, the onset of opening of the electromagnetic control device, and its opening time and the end of cam supply.

Thus by detecting the cam supply onset (bottom dead center of the pump piston) with respect to a reference marking, the bottom dead center setting can be corrected, thereby compensating for adjustment errors during assembly. By detecting the closing time, The supply onset can be regulated. From the closing onset and the closing time of the control device, the dynamic behavior of the control device can be determined and the instant of the onset of opening of the control device can be varied accordingly in such a manner that there is less fluctuation in the injection quantity from one stroke to another.

By means of the characteristics disclosed herein, further advantageous embodiments and improvements of the fuel injection pump are attainable.

One advantageous embodiment of the invention the maximum supply quantity, which is geometrically dictated by the construction of the fuel injection pump, is detected exactly, and fluctuations arising from tolerances in the cam stroke and from cam wear are eliminated.

Another advantageous feature of the invention includes the use of sensors. With this arrangement of temperature sensors, a temperature increase dictated by outflow via the electromagnetic control device can be detected, and thus the effects of temperature changes on the measured values can be better compensated for.

Still another advantageous feature of the invention includes the use of a measuring device and a measuring cylinder. This provision not only diverts leakage from the measuring device, but also attains better dynamics of the measuring piston when the measured volume is expelled from the measuring chamber, because the pressure wave that arises in the pump interior during the intake stroke of the pump piston acts upon the back end of the measuring piston.

Another advantageous feature of the invention is to provide an assembly wherein the control device and the measuring device are integrated in the pump portion of the fuel injection pump, which is advantageous in terms of cost.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
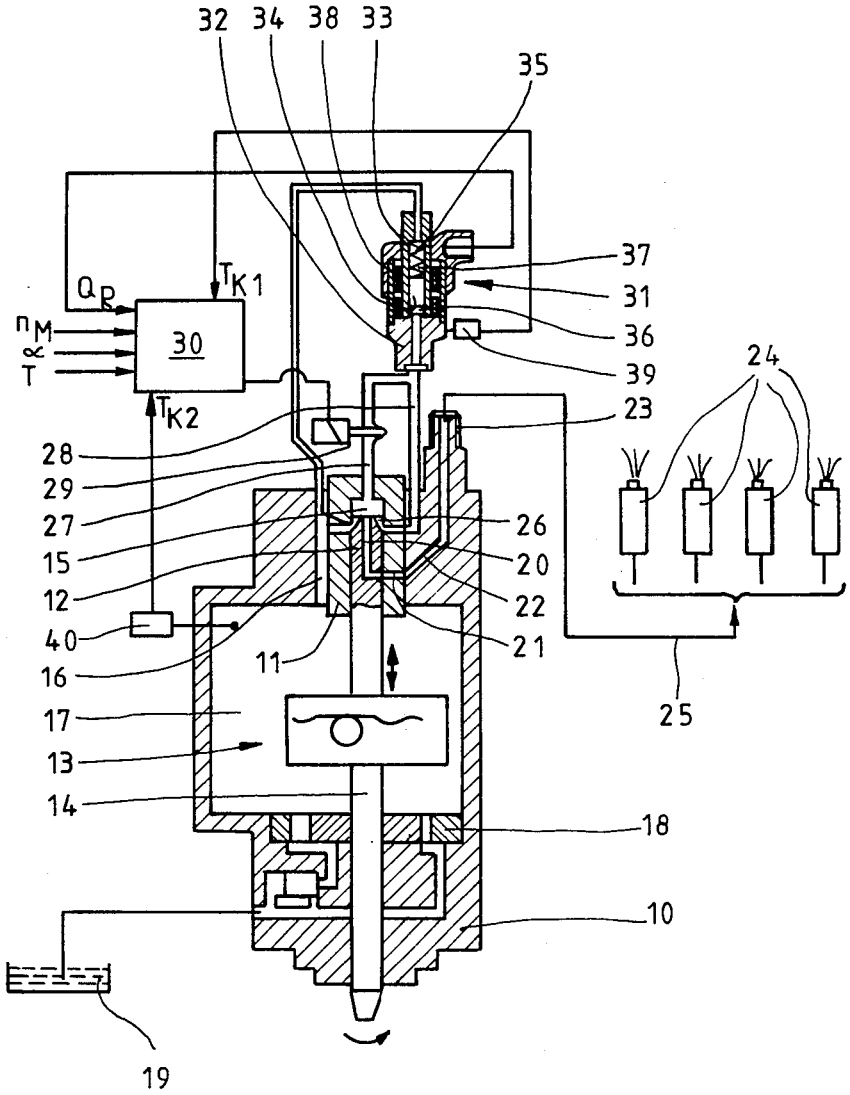
FIGS. 1 and 2 schematically show a first and second exemplary embodiment, respectively, of a fuel injection apparatus having a fuel container, fuel injection pump and injection nozzles.

In the fuel injection apparatus schematically shown in FIG. 1, a liner 11 in which a pump piston 12 executes a simultaneously reciprocating and rotating motion is disposed in a pump housing 10. The pump piston 12 is driven by a cam drive 13 via a shaft 14, which rotates in synchronism with the rpm of the internal combustion engine. A pump work chamber 15 is defined by the end face of the pump piston 12 and the liner 11 and communicates via a supply conduit 16 with a suction chamber 17 in the pump housing 10. The suction chamber 17 is supplied with fuel from a fuel container 19 via a feed pump 18.

Given a corresponding rotational position of the pump piston 12, the fuel is distributed from the pump work chamber 15, via a central conduit 20 and a radial distributor groove 21 communicating with it and located in the pump piston 12, to pressure bores 22 that discharge radially at the circumference of the pump piston 12 over which they are distributed. The pressure bores 22 discharge into connection nipples 23 in the pump housing 10, to which pressure lines 25 leading to injection nozzles 24 are connected. In the end portion of the pump piston 12 oriented toward the pump work chamber 12, longitudinal grooves are provided on the pump piston 12 that are open toward its end face and hence toward the pump work chamber 15, and by way of which communication between the supply conduit 16 and the pump work chamber 15 is established during the intake stroke of the pump piston 12.

The pump work chamber 15 communicates with a relief conduit 27, which discharges into a return conduit 28 that in turn radially penetrates the liner 11, at a point such that the outlet of the return flow conduit 28 communicates with the pump work chamber 15 via the longitudinal grooves 26 during the intake stroke of the pump piston 12, and is blocked by them during the supply stroke of the pump piston 12. Between the pump work chamber 15 and the relief conduit 27, there is an electromagnetic control device 29, which is embodied as a magnetic valve 29 and is triggered by an electronic control unit 30. The magnetic valve 29 is embodied such that it opens up the communication from the pump work chamber 15 to the relief conduit 27 in its position of repose in which no current flows through it, and blocks this communication in its working position in which it is supplied with electric current. Thus, the closure of the magnetic valve defines the supply onset, and the opening of the magnetic valve defines the end of supply by the fuel injection pump.

Connected to the relief conduit 27 is a measuring device 31, which measures the return flow fuel quantity not attaining injection through the injection nozzles 24 during a supply stroke of the pump piston 12. The measuring device 31 has a measuring cylinder 33 embodied in its housing 32, as well as a measuring piston 34 that is axially displaceable in the measuring cylinder. The measuring piston 34, which is acted upon by a restoring spring 35, divides the measuring cylinder 33 into one cylinder section forming a measuring chamber 36 and one cylinder section forming a spring chamber 37. The measuring chamber 36 communicates with the relief conduit 27, while the spring chamber 37 is connected to the intake side of the pump piston 12, communicating there with the intake conduit 16. A travel sensor, here a measuring coil 38, detects the axial displacement position of the measuring piston 34 and emits an electrical return flow quantity signal, which is supplied to the control unit 30 and represents the course over time of the fuel quantity not attaining injection during one supply stroke of the pump piston 12. The electronic control unit 30 is also supplied with other measured values and operating characteristics of the engine in the form of electrical signals, such as rpm $n_M$ and load $\alpha$ of the engine, the exhaust gas temperature $T_{Abgas}$, the temperature $T_{K1}$ of the fuel in the measuring chamber 36, and the temperature $T_{K2}$ of the fuel in the suction chamber 17. The two temperature values just mentioned are furnished by respective temperature sensors 39 and 40, which protrude with their temperature probes into the measuring chamber 36 and suction chamber 17, respectively.

Figure 2:
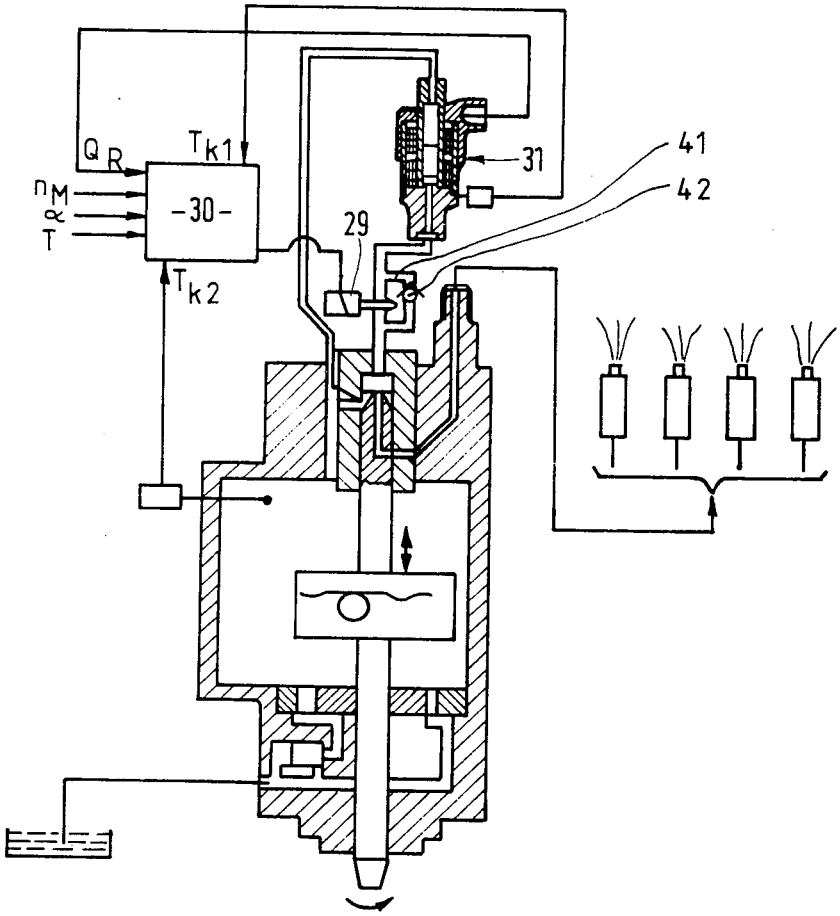

The fuel injection apparatus shown in FIG. 2 has been modified only slightly as compared with that shown in FIG. 1 and described above, so identical components are identified by the same reference numerals. Unlike FIG. 1, in the fuel injection pump of FIG. 2 the return conduit 28 has been omitted. In its place, a bypass 41 has been provided, which bypasses the magnetic valve 29 and connects the pump work chamber 15 with the relief conduit 27. A check valve 42 is disposed in the bypass 41 such that the flow direction from the pump work chamber 15 to the relief conduit 27 is blocked and the reverse flow direction is permitted.

Figure 3:
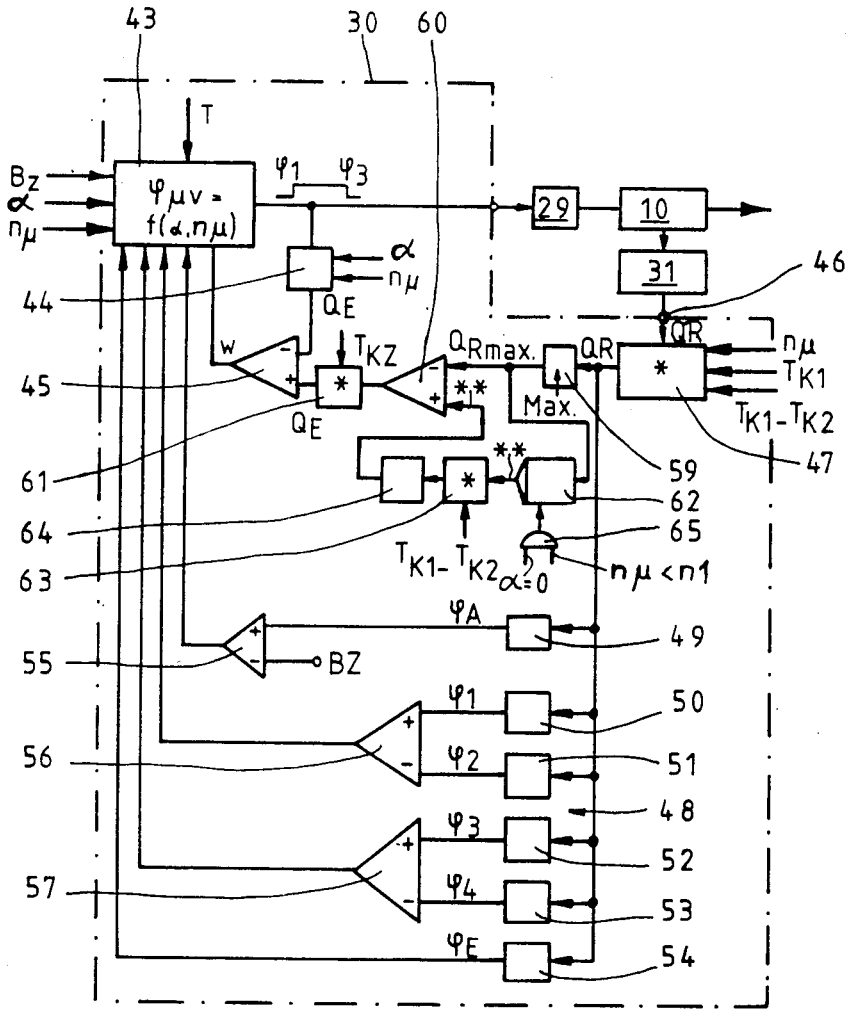
FIG. 3 is a block circuit diagram of the fuel injection pump in the fuel injection apparatus of FIG. 1 or FIG. 2.

The electronic control unit 30 generates control signals or switching pulses for the magnetic valve 29 in accordance with the return flow quantity signal and engine operating characteristics, such as rpm $n_M$, load $\alpha$ and exhaust gas tmeperature $T_{Abgas}$. To this end, the electronic control unit 30, which is shown in detail in the block circuit diagram of FIG. 3, has a first calculating register 43, containing a characteristics graph stored in memory, which with respect to a reference point BZ fixes the instants of the control signal imposition, here indicated by control angles $\phi\mu v$, as a function of the rpm $n_M$ and the load $\alpha$ of the engine. From the operating characteristics $n_M$ and $\alpha$ supplied to it, taking the reference marking BZ and the exhaust gas temperature $T_{Abgas}$ into account, the calculating register determines a switching pulse for the magnetic valve 29, the leading and trailing edge of which pulse are fixed by the control angles $\phi\mu v$ ($\phi_1$, $\phi_2$). The control unit 30 also has a second calculating register 44, in which the desired injection quantity $Q_{E\ soll}$ is stored as a function of the control angles $\phi_1$ and $\phi_3$ for the switching time of the magnetic valve 19, once again in accordance with parameters of the operating characteristics of load $\alpha$ and rpm $n_M$. From the control angles $\phi_1$ and $\phi_3$ supplied to it, this calculating register 44 determines the associated desired injection quantity at the instantaneously prevailing operating characteristics $\alpha$, $n_M$ and supplies the desired injection quantity $Q_{E\ soll}$ to a comparator 45, which has also been supplied with the value of the actual injection quantity $Q_{E\ ist}$. The control deviation w appearing at the output of the comparator is supplied to the calculating register 43, which uses the control deviation w to correct the switching instants $\phi_1$ and $\phi_3$ of the magnetic valve, the correction being done such that the control deviation w becomes as nearly zero as possible.

The return flow quantity signal $Q_R$ generated by the measuring device 31 first, via the input 46 of the electronic control unit 30, reaches a first correcting element 47, in which the return flow quantity signal is corrected, so as to compensate for the leakage at the measuring piston 34 of the measuring device 31 and for the temperature-dictated change in density of the fuel, with the instantaneous engine rpm $n_M$, the measured temperature value $T_{K1}$ furnished by the temperature sensor 39, and the difference $T_{K1}-T_{K2}$ between the temperature values being emitted by the two temperature sensors 39, 40.

Figure 4:
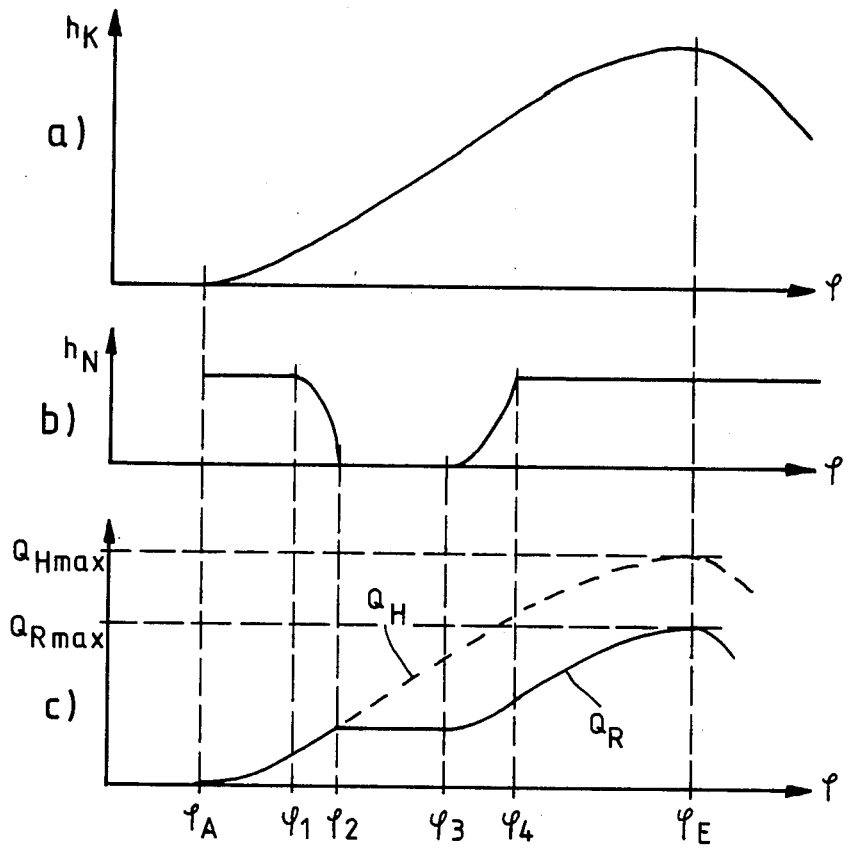
FIGS. 4, *a–c* shows diagrams of various parameters in the fuel injection pump.

The return flow quantity signal $Q_R$ picked up at the output of the correcting element 47 is shown in FIG. 4c in accordance with the rotational or control angle of the lifting cam of the cam drive that drives the pump piston 12. When the engine rpm is taken into account, the time can also be plotted, instead of the control angle, as an independent variable. In the two other diagrams of FIG. 4, with the same dependency, the course of the pump piston stroke $h_K$, which corresponds to the cam stroke of the cam of the cam drive 13 that drives the pump piston, and the stroke $h_N$ of the magnetic valve needle of the magnetic valve 29 are shown (diagram a and diagram b). At the control angle $\phi_A$, the supply stroke of the pump piston 12 begins. At the control angle $\phi_1$, the magnetic valve 29 is supplied with a switching pulse, which disappears again at the control angle $\phi_3$. At the control angle $\phi_2$, after the switching pulse has been imposed, the magnetic valve 29 is completely closed, and at the control angle $\phi_4$, after the switching pulse has disappeared, the magnetic valve is once again completely opened. The differences $\phi_2-\phi_1$ and $\phi_4-_3$ are the travel times of the magnetic valve needle upon the closure and opening, respectively, of the magnetic valve 29. At the control angle $\phi_E$, the pump piston 12 has reached top dead center, and the supply stroke of the pump piston 12 is completed.

In the return flow quantity signal $Q_R$ shown in FIG. 4c, fluctuations are clearly visible at the control angles $\phi_A$, $\phi_1-\phi_4$ and $\phi_E$. These fluctuations are significant for these control angles, so that by detection of the fluctuation points in the return flow quantity signal $Q_R$, the corresponding control angles can be measured exactly. To this end, the control unit 30 has a fluctuation detector 48, which includes a number of evalustion units 49–54, for each of the control angles mentioned, $\phi_A$, $\phi_E$, and $\phi_1$–$\phi_4$. In these evaluation units 49–54, the fluctuation points are detected, for instance by means of differentiation, and the instant of their appearance in the signal is emitted in the form of the control angles $\phi_A$, $\phi_E$, $\phi_1$–$\phi_2$ with respect to the reference marking BZ. The control angle $\phi_A$ is compared in a comparator 55 with the reference marking BZ, and the difference is supplied to the first calculating register 43. The control angles $\phi_1$ and $\phi_2$ are subtracted from one another in a first subtracter 56, and the control angles $\phi_3$ and $\phi_4$ are subtracted from one another in a second subtracter 57. The amounts of the differences, as well as the control angle $\phi_E$, are furnished to the first calculating register 43. The calculating register 43, in correcting the switching instants for the magnetic valve 29 (control angle $\phi_1$ and control angle $\phi_3$), makes use of not only the control deviation between the desired injection quantity $Q_{E\ soll}$ and the actual injection quantity $Q_{E\ ist}$, but also the last-mentioned input signals supplied to it, which are derived from the control angles $\phi_A$, $\phi_E$ and $\phi_1 - \phi_4$.

The actual injection quantity $Q_{E\ ist}$ is determined from the maximum of the return flow quantity signal and the geometrically defined maximum supply quantity that can be pumped by the pump piston during its supply stroke from the control angle $\phi_A$ (supply stroke onset) to the control angle $\phi_E$ (supply stroke end). To this end, the output of the first correcting element 47 is connected via a maximum detector 59, which measures the maximum $Q_{R\ max}$ of the corrected return flow quantity signal $Q_R$ appearing at control angle $\phi_E$, to one input of a subtracter 60, the other input of which is supplied with the supply quantity maximum value $Q_{H\ max}$ of the geometrically possible maximum supply quantity $Q_H$. The difference signal at the output of the subtracter 60 is compensated for in a second correcting element 61 with respect to the temperature value $T_{K2}$ furnished by the temperature sensor 40 and supplied to the comparator 45 as the actual value for the injection quantity $Q_{E\ ist}$.

Since the supply quantity maximum value $Q_{H\ max}$ is not fixed invariably but can instead fluctuate from cam stroke tolerance and cam wear, this maximum value $Q_{H\ max}$ is measured with the aid of the measuring device 31 when the magnetic valve 29 is not switched, during the supply stroke. The course of the corrected return flow quantity signal $Q_R$ at the output of the correcting element 47 during the supply stroke when the magnetic valve 29 is not switched, that is, when there is a continuously open communication between the pump work chamber 15 and the relief conduit 27, is shown in dashed lines in FIG. 4c and marked $Q_H$. The maximum of the return flow quantity signal that can be picked up at the output of the maximum detector is then the supply quantity maximum value $Q_{H\ max}$, which is delivered via a gate element 62 and a third correcting element 63 to a memory element 64. The output of the memory element 64, at which the actual supply quantity maximum value $Q_{H\ max}$ is always present, is connected to one input of the subtracter 60. The gate element is always open whenever engine operating conditions in which no injection is taking place are present, or in other words when the magnetic valve 29 is not receiving a switching pulse from the control unit 30. This is the case in an internal combustion engine, used as a motor, in in the state known as overrunning ($\alpha=0$). In order to avoid dynamic measuring errors, the gate element 62 is also opened only when the engine has reached a low rpm level. To this end, a logic element 65 is connected to the control input of the gate element 62; the two inputs of the logic element are occupied by a digital load signal $\alpha$ and a digital rpm signal $n_M$. The two inputs of the logic element 65, which is embodied as an AND gate, are always logical 1 when $\alpha=0$ and the rpm $n_M$ is less than a predetermined value $n_1$, and are always logical 0 whenever these conditions are not present. If the gate element 62 is opened with a "logical 1 signal", the output value $Q_{R\ max}$ of the maximum detector 49 is supplied to the third correcting element 63, here corrected with the difference $T_{K1} - T_{K2}$ of the temperature values of the temperature sensors 39, 40 and recorded as the supply quantity maximum value $Q_{H\ max}$ in the memory element 64, writing over the old, previously stored value in the memory. In this way, an updated value, taking wear into account, for the maximum geometrically dictated supply quantity is always available to the subtracter 60.

The overall result, because of the variety of corrective values taken into account in fixing the switching instants for the magnetic valve 29, is a highly accurate closed-loop control of the fuel quantity injected through the injection nozzles.

By taking the exhaust gas temperature into account as a corrective variable in setting the switching times $\phi\mu v$, that is, $\phi_1$ and $\phi_3$, the influence of changes in density of the fuel resulting from fluctuations in fuel quantity are taken into account.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having at least one pump piston arranged to define a pump work chamber for generating an injection pressure; an electromagnetic control device to control a relief conduit leading to said pump work chamber in order to define the onset and end of supply; a measuring device arranged to communicate with said relief conduit, said measuring device adapted to measure the return flow quantity of fuel during one supply stroke of said pump piston and thereby emit an electrical return flow quantity signal; and electronic control unit associated with said fuel injection pump, said control unit adapted to impose control signals for blocking or opening the relief conduit upon said magnetic control device in accordance with the return flow quantity signal and engine operating characteristics such as load, rpm and temperature, said control unit (30) further having a fluctuation detector (48), which detects fluctuations in the return flow quantity signal ($Q_R$) and emits the appearance of chronological or spatial fluctuations, measured with respect to a reference point (BZ), in the form of detection signals ($\phi_A$, $\phi_B$, $\phi_E$, $\phi_1-\phi_4$), and further that with the detection signals ($Q_1$, $Q_E$, $Q_1-Q_4$), the imposition of the control signals ($Q_{MV}$) is corrected.

2. An injection pump as defined by claim 1, in which said measuring device (31) includes a measuring cylinder (33) and a measuring piston (34) displaceable therein counter to a restoring spring (35), said measuring piston (34) being adapted to divide said measuring cylinder (33) into one cylinder section connected to said relief conduit (27) and thereby arranged to form said measuring chamber (36) and another cylinder section remote from the measuring chamber simultaneously arranged to form a spring chamber (37) for said restoring spring (35), said measuring piston (34) having a displacement path from which the return flow quantity signal ($Q_R$) is derived, and further that the cylinder section remote from said measuring chamber (36) communicates with the intake side of said pump piston (12) preferably with a supply line (16) which leads to said pump work chamber (15).

3. An injection pump as defined by claim 1, in which said measuring device (31) includes a measuring chamber having a temperature sensor, a further temperature sensor disposed in a fuel-filled suction chamber which communicates with said pump work chamber, said temperature sensors arranged to detect fuel temperature ($T_{K1}$, $T_{K2}$), a first correcting element (47) is provided for correcting the return flow quantity signal ($Q_R$) with the difference of the temperature values ($T_{K1}$, $T_{K2}$) of the first and second temperature sensors (39, 40), on the one hand, and with the temperature value ($T_{K1}$) of the first temperature sensor (39), on the other, and a second correcting element (63) is also provided for correcting the supply quantity maximum value ($Q_{H\ max}$) with the difference of the temperature values ($T_{K1}$, $T_{K2}$) of the first and second temperature sensors.

4. An injection pump as defined by claim 3, in which said measuring device (31) includes a measuring cylinder (33) and a measuring piston (34) displaceable therein counter to a restoring spring (35), and measuring piston (34) being adapted to divide said measuring cylinder (33) into one cylinder section connected to said relief conduit (27) and thereby arranged to form said measuring chamber (36) and another cylinder section remote from the measuring chamber simultaneously arranged to form a spring chamber (37) for said restoring spring (35), said measuring piston (34) having a displacement path from which the return flow quantity signal ($Q_R$) is derived, and further that the cylinder section remote from said measuring chamber (36) communicates with the intake side of said pump piston (12) preferably with a supply line (16) which leads to said pump work chamber (15).

5. An injection pump as defined by claim 1, in which said control unit (30) includes a characteristics graph stored in memory, said graph adapted to fix the instants, related to a reference point (BZ), of said control signal imposition (control angle $\phi\mu v$) as a function of the engine operating characteristics such as rpm ($n_M$) and load ($\alpha$), fuel temperature ($T_{K1}$, $T_{K2}$), and further that said detection signals ($\phi_A$, $\phi_E$, $\phi_1-\phi_4$) are used to correct the control angle ($\phi\mu v$ ) which is determined from the charcteristics graph for predetermined operating characteristics.

6. An injection pump as defined by claim 5, in which said measuring device (31) includes a measuring cylinder (33) and a measuring piston (34) displaceable therein counter to a restoring spring (35), said measuring piston (34) being adapted to divide said measuring cylinder (33) into one cylinder section connected to said relief conduit (27) and thereby arranged to form said measuring chamber (36) and another cylinder section remote from the measuring chamber simultaneously arranged to form a spring chamber (37) for said restoring spring (35), said measuring piston (34) having a displacement path from which the return flow quantity signal ($Q_R$) is derived, and further that the cylinder section remote from said measuring chamber (36) communicates with the intake side of said pump piston (12) preferably with a supply line (16) which leads to said pump work chamber (15).

7. An injection pump as defined by claim 5, in which said measuring device (31) includes a measuring chamber having a temperature sensor, a further temperature sensor disposed in a fuel-filled suction chamber which communicates with said pump work chamber, said temperature sensors arranged to detect fuel temperature ($T_{K1}$, $T_{K2}$), a first correcting element (47) is provided for correcting the return flow quantity signal ($Q_R$) with the difference of the temperature values ($T_{K1}$, $T_{K2}$) of the first and second temperature sensors (39, 40), on the one hand, and with the temperature value ($T_{K1}$) of the first temperature sensor (39), on the other, and a second correcting element (63) is also provided for correcting the supply quantity maximum value ($Q_{H\ max}$) with the difference of the temperature values ($T_{K1}$, $T_{K2}$) of the first and second temperature sensors.

8. An injection pump as defined by claim 7, in which said relief conduit (27) is arranged to communicate with a return conduit (28), which during the intake stroke of said pump piston (12) also communicates with said pump work chamber (15) and during the supply stroke of said pump piston (12) is closed thereby.

9. An injection pump as defined by claim 7, in which said electronic control device comprises a bypass (41), which effects communication of said pump work chamber (15) with said relief conduit (27), and further that a chamber valve (42) disposed in the bypass (41) has a a flow direction oriented toward the pum work chamber (15).

10. An injection pump as defined by claim 5, in which said control unit (30) comprises a difference former (60) supplied on the one hand with the maximum value ($Q_{R\ max}$) of the return flow quantity signal ($Q_R$) and on the other with a supply quantity maximum value ($Q_{H\ max}$) for the geometrically maximum possible supply quantity ($Q_H$), and said difference former also including a comparator (45) to which the actual value of the injection quantity ($Q_{E\ ist}$) that can be picked up at the output of the difference former (60) is supplied together with the desired value, predetermined by the particular control angle ($\phi\mu v$), of the injection quantity ($Q_{E\ soll}$), and further that the control deviation that can be picked up at the output of the comparator (45) is used for correcting the control angle ($\phi\mu v$).

11. An injection pump as defined by claim 10, in which said measuring device (31) includes a measuring chamber having a temperature sensor, a further temperature sensor disposed in a fuel-filled suction chamber which communicates with said pump work chamber, said temperature sensors arranged to detect fuel temperature ($T_{K1}$, $T_{K2}$), a first correcting element (47) is provided for correcting the return flow quantity signal ($Q_R$) with the difference of the temperature values ($T_{K1}$, $T_{K2}$) of the first and second temperature sensors (39, 40), on the one hand, and with the temperature value ($T_{K1}$) of the first temperature sensor (39), on the other, and a second correcting element (63) is also provided for correcting the supply quantity maximum value ($Q_{H\ max}$) with the difference of the temperature values ($T_{K1}$, $T_{K2}$) of the first and second temperature sensors.

12. An injection pump as defined by claim 10, in which said measuring device (31) includes a measuring cylinder (33) and a measuring piston (34) displaceable therein counter to a restoring spring (35), said measuring piston (34) being adapted to divide said measuring cylinder (33) into one cylinder section connected to said relief conduit (27) and thereby arranged to form said measuring chamber (36) and another cylinder section remote from the measuring chamber simultaneously arranged to form a spring chamber (37) for said restoring spring (35), said measuring piston (34) having a displacement path from which the return flow quantity signal ($Q_R$) is derived, and further that the cylinder section remote from said measuring chamber (36) communicates with the intake side of said pump piston (12) preferably with a supply line (16) which leads to said pump work chamber (15).

13. An injection pump as defined by claim 10, in which said supply quantity maximum value ($Q_{H\,max}$) is determined as a maximum of the return flow quantity signal emitted by said measuring device (31) while said pump work chamber (15) is opened toward said relief conduit (27) during the entire supply stroke of said pump piston (12).

14. An injection pump as defined by claim 13, in which said measuring device (31) includes a measuring chamber having a temperature sensor, a further temperature sensor disposed in a fuel-filled suction chamber which communicates with said pump work chamber, said temperature sensors arranged to detect fuel temperature ($T_{K1}$, $T_{K2}$), a first correcting element (47) is provided for correcting the return flow quantity signal ($Q_R$) with the difference of the temperature values ($T_{K1}$, $T_{K2}$) of the first and second temperature sensors (39, 40), on the one hand, and with the temperature value ($T_{K1}$) of the first temperature sensor (39), on the other, and a second correcting element (63) is also provided for correcting the supply quantity maximum value ($Q_{H\,max}$) with the difference of the temperature values ($T_{K1}$, $T_{K2}$) of the first and second temperature sensors.

15. An injection pump as defined by claim 13, in which said measuring device (31) includes a measuring cylinder (33) and a measuring piston (34) displaceable therein counter to a restoring spring (35), said measuring piston (34) being adapted to divide said measuring cylinder (33) into one cylinder section connected to said relief conduit (27) and thereby arranged to form said measuring chamber (36) and another cylinder section remote from the measuring chamber simultaneously arranged to form a spring chamber (37) for said restoring spring (35), said measuring piston (34) having a displacement path from which the return flow quantity signal ($Q_R$) is derived, and further that the cylinder section remote from said measuring chamber (36) communicates with the intake side of said pump piston (12) preferably with a supply line (16) which leads to said pump work chamber (15).

* * * * *